US010991502B2

(12) United States Patent
Ruther et al.

(10) Patent No.: US 10,991,502 B2
(45) Date of Patent: Apr. 27, 2021

(54) BOBBIN WOUND ELECTRICAL REACTOR ASSEMBLY

(71) Applicant: TCI, LLC, Germantown, WI (US)

(72) Inventors: Wesley J. Ruther, Fredonia, WI (US); Robert H. Wagner, Slinger, WI (US); George N. Wood, Brown Deer, WI (US); David S. Wroblewski, Waukesha, WI (US)

(73) Assignee: TCI, LLC, Germantown, WI (US)

( * ) Notice: Subject to any disclaimer, the term of this patent is extended or adjusted under 35 U.S.C. 154(b) by 294 days.

(21) Appl. No.: 16/188,526

(22) Filed: Nov. 13, 2018

(65) Prior Publication Data

US 2019/0148051 A1 May 16, 2019

Related U.S. Application Data

(60) Provisional application No. 62/584,535, filed on Nov. 10, 2017.

(51) Int. Cl.
*H01F 27/26* (2006.01)
*H01F 27/29* (2006.01)
(Continued)

(52) U.S. Cl.
CPC ..... *H01F 27/263* (2013.01); *H01F 27/06* (2013.01); *H01F 27/2823* (2013.01);
(Continued)

(58) Field of Classification Search
CPC ..... H01F 27/26; H01F 27/263; H01F 27/266; H01F 27/30; H01F 27/303; H01F 27/306;
(Continued)

(56) References Cited

U.S. PATENT DOCUMENTS 3,896,407 A 7/1975 Long
4,536,734 A 8/1985 Mabuchi
(Continued)

FOREIGN PATENT DOCUMENTS

CN 202711916 1/2013
CN 204480857 7/2015
(Continued)

OTHER PUBLICATIONS

International Search Report for PCT/US18/6063; dated Jan. 22, 2019.

(Continued)

*Primary Examiner* — Tszfung J Chan
(74) *Attorney, Agent, or Firm* — James A. Joyce; Godfrey & Kahn, S.C.

(57) ABSTRACT

A reactor assembly including a first core formed of a plurality of stacked E-shaped planar metal laminates welded together, and a second core formed of a plurality of stacked I-shaped planar metal laminates welded together. The first core includes a plurality of legs having bottom surfaces, the plurality of legs including first and second outer legs and a center leg. A bobbin assembly is provided with a plurality of bobbins each having a hollow inner cavity, and wire wound around the bobbin. The plurality of bobbins including first and second outer bobbins and a center bobbin. A U-shaped spring clip includes a pair of clip arms that each extend down through a different one of the inner cavities, and tab apertures that are engaged with matching latching tabs on the second core, such as on a mounting foot secured to the second core.

14 Claims, 6 Drawing Sheets

(51) Int. Cl.
*H01F 27/32* (2006.01)
*H01F 27/28* (2006.01)
*H01F 27/06* (2006.01)
*H01F 27/30* (2006.01)

(52) U.S. Cl.
CPC ..... *H01F 27/29* (2013.01); *H01F 27/306* (2013.01); *H01F 27/325* (2013.01)

(58) Field of Classification Search
CPC .... H01F 27/325; H01F 5/02; H01F 2005/022; H01F 2005/025; H01F 2005/027
USPC ..... 336/197, 210
See application file for complete search history.

(56) References Cited

U.S. PATENT DOCUMENTS

| | | | | |
|---|---|---|---|---|
| 4,602,236 | A | 7/1986 | Shelby et al. | |
| 5,317,300 | A | 5/1994 | Boesel | |
| 5,396,210 | A * | 3/1995 | Purohit | H01F 27/263 336/196 |
| 5,731,666 | A | 3/1998 | Folker et al. | |
| 6,060,975 | A | 5/2000 | Rowe | |
| 6,326,874 | B1 | 12/2001 | Banzi et al. | |
| 7,456,719 | B2 * | 11/2008 | Suzuki | H01F 38/10 336/198 |
| 8,907,758 | B2 | 12/2014 | Nomura et al. | |
| 9,281,114 | B2 | 3/2016 | Oberle | |
| 9,350,267 | B2 | 5/2016 | Ito et al. | |
| 9,514,878 | B2 | 12/2016 | Nakatsu et al. | |
| 9,679,692 | B2 | 6/2017 | Yamashima et al. | |
| 2002/0014941 | A1 | 2/2002 | Yoshioka | |
| 2011/0156853 | A1 | 6/2011 | Kato et al. | |
| 2012/0242444 | A1 * | 9/2012 | Tseng | H01F 27/306 336/170 |
| 2016/0049238 | A1 | 2/2016 | Young | |

FOREIGN PATENT DOCUMENTS

| | | | | |
|---|---|---|---|---|
| CN | 104658743 | | 5/2017 | |
| CN | 206179647 | | 5/2017 | |
| FR | 2427670 | A1 * | 12/1979 | H01F 27/263 |
| JP | 60101724 | U * | 7/1985 | |
| JP | 08111322 | A * | 4/1996 | |
| JP | H1140440 | | 2/1999 | |
| JP | 3255211 | | 2/2002 | |
| KR | 20170103267 | | 9/2017 | |
| WO | WO2015120802 | | 8/2015 | |
| WO | WO2016189767 | | 12/2016 | |

OTHER PUBLICATIONS

Schmitt, S., S. Beyer, and D. Kampen. "Reducing Noise of Sheeted Electrical Steel Inductors in PWM Operation." PCIM International Conference on Power Electronics, Intelligent Motion and Power Quality, Nuremberg. 2009. https://web.archive.org/web/20171115055526/https://f1.hshannover.de/fileadmin/media/doc/f1/eaa/Publikationen/PCIM-2009_Reducing-Noise.pdf.

* cited by examiner

BOBBIN WOUND ELECTRICAL REACTOR ASSEMBLY

CROSS-REFERENCE TO RELATED APPLICATIONS

This application claims priority to and incorporates by reference herein U.S. Provisional Patent Application Ser. No. 62/584,535 filed on Nov. 10, 2017.

FIELD OF THE INVENTION

This invention relates generally to electrical reactors and in particular to a bobbin wound electrical reactor.

BACKGROUND

Electrical reactors are used in various power quality applications on single phase or three electrical grids on a wide range of voltages (e.g. 208V, 230V, 277V, 480V, 600V, 690V). These reactors are often constructed from a magnetic steel core with a conductive coil made of copper or aluminum. In order to mitigate eddy current losses within the reactor core when applied to high harmonic currents, laminated core steel is used for the E-shaped and I-shaped core sections. Laminated core steel is typically comprised of many individual layers or laminations, requiring special handling and stacking of the core pieces prior to being used in the reactor assembly. Motion of the separate lamination pieces from magnetic fields, when the reactor is operated as intended with harmonic currents, cause undesirable noise. And it is important that the E-shaped sections and the I-shaped sections have the same number of laminations. These electrical reactors require specialized manufacturing techniques to make the units more power efficient, less audibly noisy, withstand harsh industrial environmental conditions, and to meet electrical safety standards. To address these requirements, mechanical connectors such as clamps or braces are added to clamp these laminations together to reduce noise, but adding these parts and fasteners increases labor required to assemble the reactor. Alternatively, specialized, time consuming manufacturing techniques are often employed, including a varnish dip immersion followed by an hours-long heat cure treatment process used to sound proof the reactor and to environmentally protect the reactor laminations and coil. This process can take hours to pre-heat the reactor, immerse in varnish, and cure in a high temperature oven. Aside from the queue time required by this process, a significant amount of energy, whether originating from fossil fuels such as natural gas, or in general, electrical power, is required to operate industrial ovens at high temperature for long periods of time.

As such, reactor assemblies with improved features to address the aforementioned drawbacks, as well as other deficiencies in the prior art, are desired.

SUMMARY OF THE INVENTION

As illustrated by the following description and shown in the drawing figures, the present invention overcomes the limitations and disadvantages of existing reactor assemblies, at least by utilizing effective design and manufacturing practices to reduce reactor assembly time, material handling time, heat treatment time, and reactor noise. In at least some embodiments, these goals can be accomplished by reducing individual parts and optimizing assembly methods to connect the reactor portions together with a simple click. The use of epoxy in the manufacturing process reduces reactor noise during operation and improves assembly consistency, as well as reducing or eliminating the time associated with a varnish treat process. Mechanical fasteners can also be eliminated by optimizing the reactor design/assembly process, which in turn improves structural integrity, and reduces manufacturing queue time, assembly time, and material cost associated with bobbin wound electrical reactors in the present state of the art.

In at least some embodiments, a reactor assembly is provided that includes a first core comprising a plurality of stacked E-shaped planar metal laminates welded together to form a singular unit. The first core further includes a plurality of legs having bottom surfaces and the legs extend perpendicularly from a top support portion. In at least some embodiments, the plurality of legs includes a first outer leg, a second outer leg, and a center leg. A bobbin assembly comprises a plurality of bobbins each having wire windings thereon and a hollow inner cavity. The plurality of bobbins include a first outer bobbin, a second outer bobbin, and a center bobbin. Each of the plurality of bobbins receives therein one of the plurality of legs. A terminal block is provided atop the bobbins and interconnected with the wire windings. A second core comprises a plurality of stacked I-shaped planar metal laminates welded together to form a singular unit. The second core includes a top surface and a bottom surface. The top surface is spaced apart from the bottom surfaces of the legs by a precisely controlled gap. A mounting foot is secured to or formed in the bottom surface of the second core, and includes one or more latching tabs. A U-shaped spring clip includes a pair of clip arms that each have an inside surface and a tab aperture. The spring clip extends over an upper surface of the top support portion of the bobbin assembly. A first of the pair of clip arms extends downward through the inner cavity of the first outer bobbin and the second of the pair of clip arms extends downward through the inner cavity of the second outer bobbin. The tab apertures engage with the latching tabs to secure the spring clip to the mounting foot.

BRIEF DESCRIPTION OF THE DRAWINGS

Embodiments of the reactor assembly are disclosed with reference to the accompanying drawings and are for illustrative purposes only. The invention is not limited in its application to the details of construction or the arrangement of the components illustrated in the drawings. The invention is capable of other embodiments or of being practiced or carried out in other various ways.

FIG. 7 is a cross-sectional front view of the reactor assembly of FIG. 4 taken along lines 7-7 of FIG. 4, with the terminal block cover not included.

FIG. 11 is a close up view of a portion of the reactor assembly shown in

FIG. 7.

DETAILED DESCRIPTION

Figure 1:
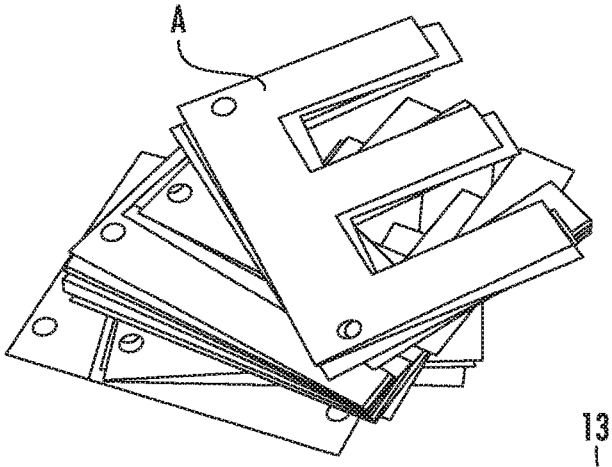
FIG. 1 PRIOR ART
FIG. 1 is a perspective view of a plurality of loose reactor core laminations, as found in the prior art.
Figure 2:
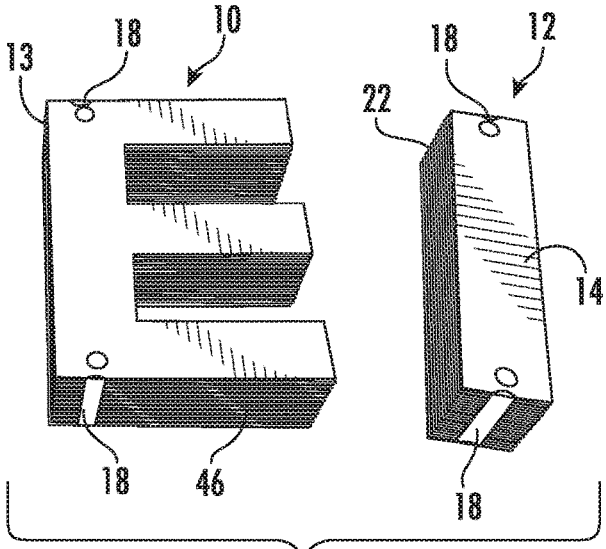
FIG. 2 is a perspective view of secured first core and second core laminations that form part of an exemplary reactor assembly.
Figure 3:
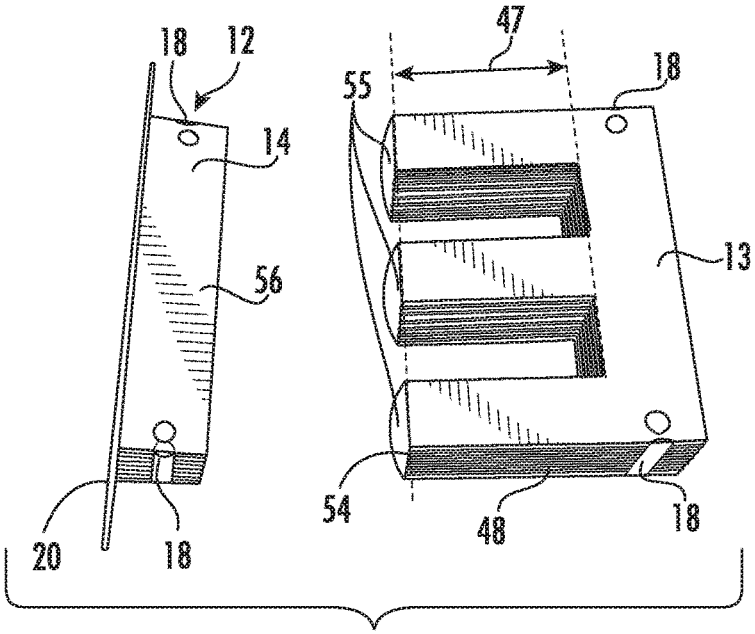
FIG. 3 is a perspective view of the first core and second core laminations of FIG. 2, with a reactor mounting foot secured to the second core.

FIG. 1 illustrates a plurality of loose planar metal reactor core laminations A, as found in the prior art. Reactor core laminations are generally comprised of loose steel pieces that are installed separately, which results in numerous manufacturing and operational performance issues. FIGS. 2 and 3 illustrate a first core 10 (i.e. an E-core) comprised of a plurality of E-shaped metal laminations 13, and a second core 12 (i.e. an I-core), comprised of a plurality of I-shaped planar metal laminations 14. In stark contrast to the prior art, the metal laminations 13 of the first core 10 are permanently secured together to form a singular unit prior to assembly of a reactor assembly 16. Likewise, the metal laminations 14 of the second core 12 are permanently secured together to form a singular unit prior to assembly of a reactor assembly 16.

In at least some embodiments, the permanent securement of the laminations is performed by stacking the laminations on top of each other and adding a weld 18 that extends across all of the laminations, thereby securing each lamination to the next. The number and location of welds 18 can vary, although in at least some embodiments, a weld 18 is placed at opposite ends of the laminations to avoid interference with magnetic fields in a reactor gap area. Permanent securement of the laminations allows easier handling during assembly, as only two pieces are provided versus dozens of individual laminations that need to be precisely squared and aligned before final assembly. The need to count the laminations during reactor assembly, to ensure that the correct number is included in each core, is eliminated. Permanent securement of the laminations also serves to reduce the audible noise generated by the reactor assembly 16 during operation, as it reduces the vibration between the laminations.

As seen in FIG. 3, a reactor mounting foot 20 can be welded to the bottom surface 22 of the second core 12. As shown, the reactor mounting foot 20 can be at least in part, plate-like, while in other embodiments it can vary in size and shape as desired for mounting the reactor assembly 16 to various surfaces.

Figure 4:
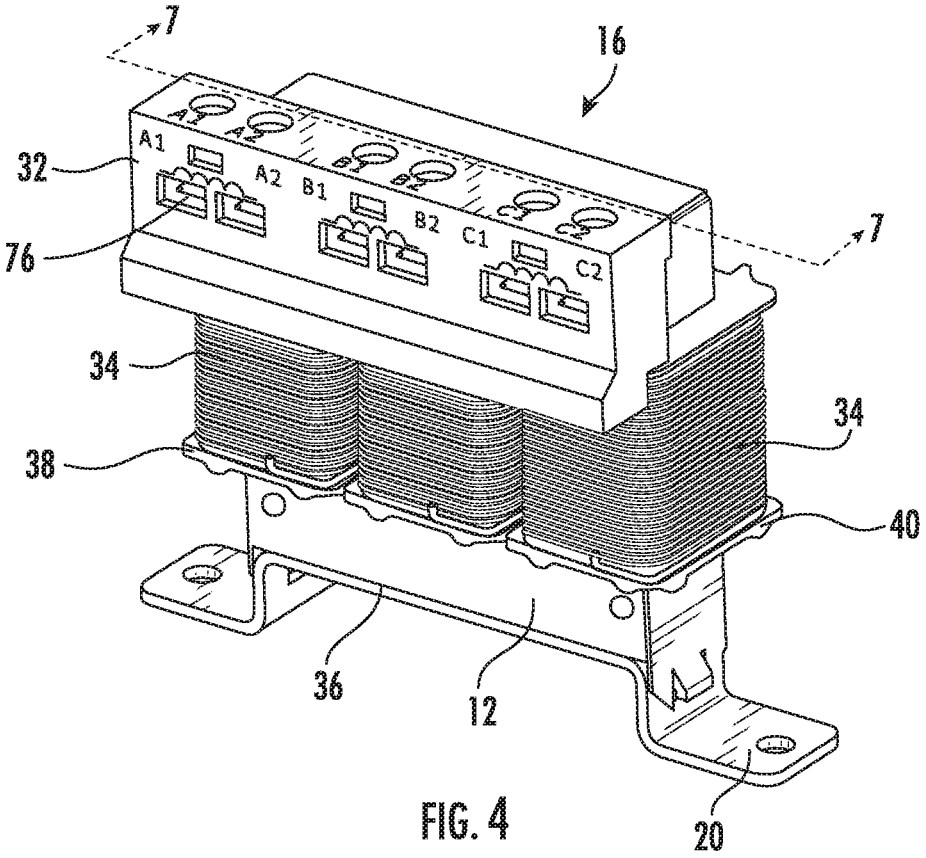
FIG. 4 is perspective view of an exemplary embodiment of the reactor assembly.
Figure 5:
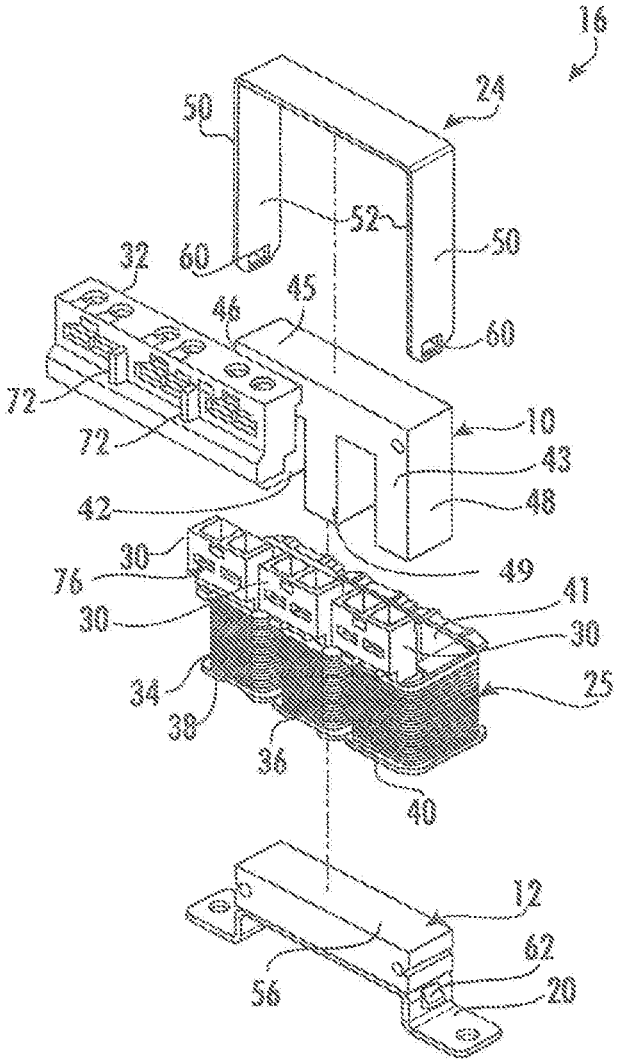
FIG. 5 is an exploded perspective view of the reactor assembly of FIG. 4.
Figure 6:
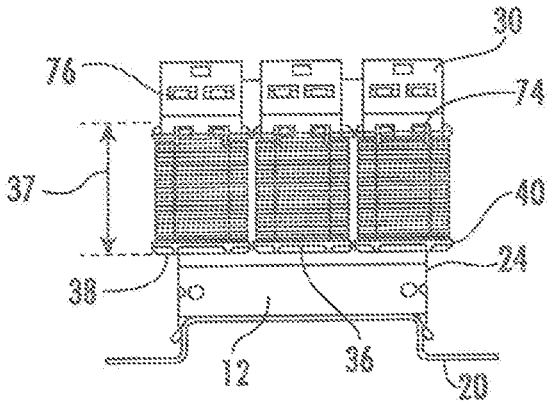
FIG. 6 is a front view of the reactor assembly of FIG. 4 without the terminal block cover.

Referring to FIGS. 4 and 5, a perspective view of an exemplary embodiment of the reactor assembly 16 is provided, along with an exploded perspective view of the reactor assembly 16. As shown, and in at least some embodiments, the reactor assembly 16 includes the first core or E-core 10, the second core or I-core 12, the reactor mounting foot 20, a spring clip 24, a bobbin assembly 25, and a terminal block cover 32 that fits over terminal blocks 30 on the bobbin assembly 25. Each of the bobbins is shown wound with wire 34 to form a coil. The reactor assembly 16 shown is a three-phase reactor, and as such, the assembly 25 includes three wound bobbins, namely a center bobbin 36, a first outer bobbin 38, and a second outer bobbin 40. Each bobbin 36, 38, 40 has a bobbin length 37 (FIGS. 6 and 7) that includes a hollow inner cavity 41 sized and shaped so as to complimentarily receive legs of the E-core 10 at least partially therethrough. The bobbins 36, 38, 40 in the bobbin assembly 25 can be separately or integrally formed (as shown, for example, in FIG. 8). A side view of the reactor assembly 16 without the terminal block cover 32 attached is shown in FIG. 6, and in FIG. 7, a cross-sectional front view of the reactor assembly 16 taken along a line 7-7 of FIG. 4 is shown without the terminal block cover 32 installed.

Referring to FIGS. 4-7, the E-core 10 includes a plurality of legs, including a first outer leg 42, a second outer leg 43, and a center leg 49. Each of the legs includes a leg length 47 (FIG. 3), and extends perpendicularly from a top support portion 44 having an upper surface 45. In addition, a first outer wall 46 extends along the first outer leg 42 and a second outer wall 48 extends along the second outer leg 43. The spring clip 24 includes a pair of clip arms 50 having arm inside surfaces 52, and in at least some embodiments is U-shaped.

The bobbins 36, 38, 40 are sized such that the bobbin length 37 exceeds the leg length 47, such that when the legs are passed through the bobbins, the legs do not protrude. This deliberate configuration provides a reactor gap 64 (FIGS. 7 and 11) that can be sized as desired. To assemble the reactor assembly 16, the bobbin assembly 25 is slid over the legs 42, 43, 44. Structural adhesive 55, such as epoxy, is added to the tips of the core legs 42, 43, and 44. The first core 10 is placed over the second core 12, such that bobbins 36, 38, 40 are in abutment with a top surface 56 of the second core 12. The adhesive 55 is intended to completely fill the gap 64, the space between first core 10 and second core 12. The spring clip 24 is then placed over the first core 10 such that the arm inside surfaces 52 of the clip arms 50 extend through the inner cavities 41 of the first outer bobbin 38 and the second outer bobbin 40. In this manner, the arm inside surfaces 52 are parallel and in abutment with the first outer wall 46 and second outer wall 48 of the first core 10.

Tab apertures 60 situated on the ends of the clip arms 50 are placed over latching tabs 62 that extend from the mounting foot 20, wherein the tabs 62 snap into the apertures 60 to secure the spring clip 24 to the mounting foot 20. Because the spring clip 24 in the present invention is placed inside the bobbins 38 and 40, it is made from a non-ferromagnetic material to avoid inductive heating of the spring clip 24. This can be important as the mounting foot 20 to which the spring clip 24 is attached, is typically used to mount the reactor assembly 16 to a surface that may not be sufficiently heat resistant.

Figures 7, 11:
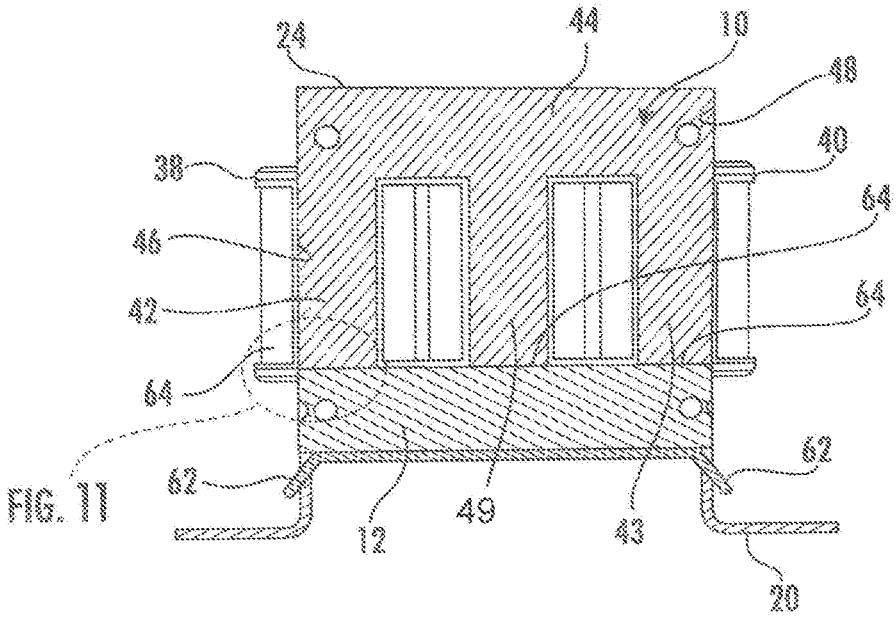

In at least some embodiments, the gap 64 includes the area between the bottom surfaces 54 of the legs 42, 43, 44 and the top surface 56 of the second core (see FIGS. 7 and 11). The application of structural adhesive serves to soundproof the reactor assembly 16 so significantly less audible noise is generated during loaded operation. Use of a single part epoxy heat cure process can take less than one hour, which is significantly less time than the traditional prior art varnish immersion, oven heat treatment process. In addition, in contrast to a prior art varnish immersion process, the structural adhesive in the gap 64 also serves to significantly bond the reactor assembly together in conjunction with the spring clip 24. The result is an improved, quieter reactor assembly 16.

Figure 8:
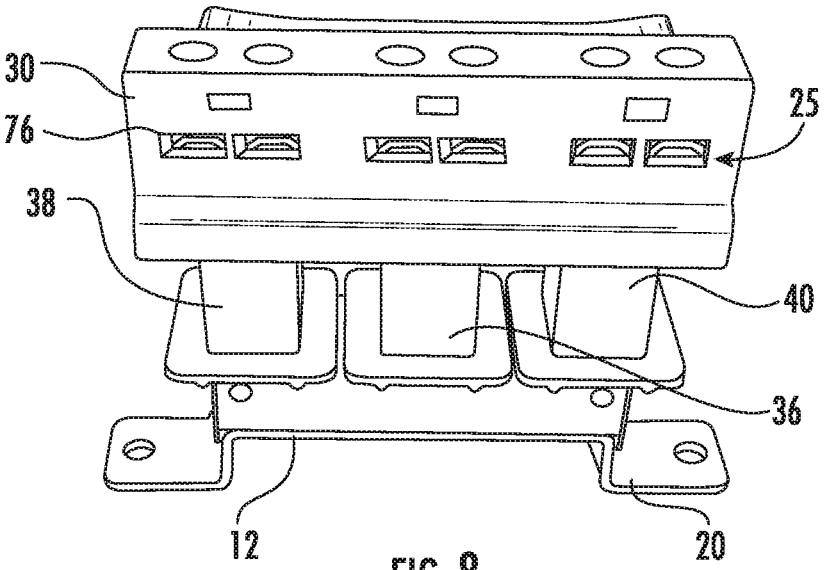
FIG. 8 is a perspective view of the reactor assembly of FIG. 6, shown without wire on the bobbins.

Referring to FIG. 8, the reactor assembly 16 is shown without wire wound on the bobbins of the bobbin assembly 25.

Referring again to FIG. 5, the terminal block cover 32 can include a plurality of outwardly extending phase-to-phase electrical barriers 72, which in at least some embodiments are planar plastic walls that extend perpendicular to an outer surface of the terminal block cover 32. These barriers 72 provide additional insulating material that in at least some embodiments, can enable the reactor assembly 16 to meet electrical safety creepage and clearance requirements for higher voltages such as 690 VAC. In at least one embodiment, a separate terminal block is provided for each bobbin, and the terminal blocks are separated by sufficient physical distance to provide phase-to-phase voltage clearance so that a cover with outwardly extending phase-to-phase electrical barriers are not required.

Figure 9:
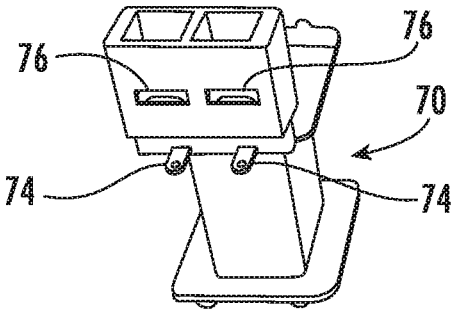
FIG. 9 is a perspective view of a bobbin assembly.
Figure 10:
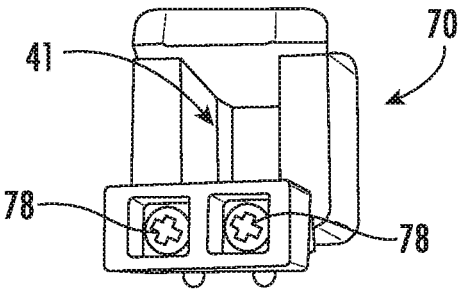
FIG. 10 is perspective view of the bobbin assembly of FIG. 9.
Figure 11:
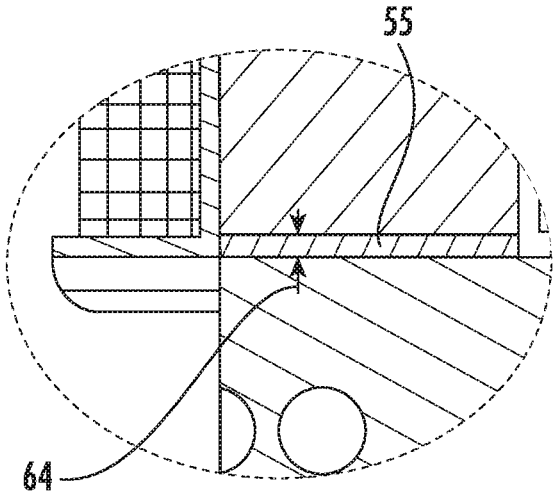
Figure 12:
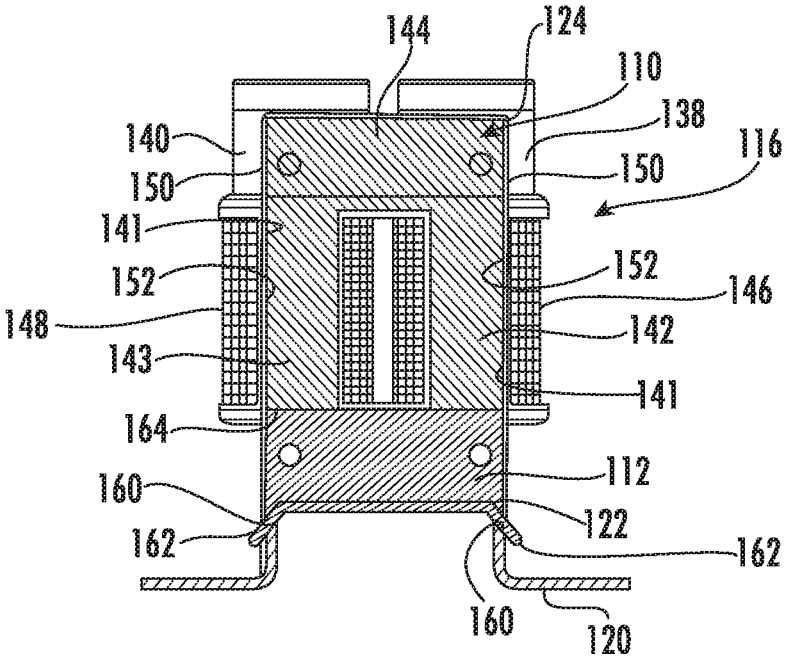
FIG. 12 is a cross-sectional front view, similar to FIG. 7, of an alternative embodiment of the invention, with the terminal block not included.

While the bobbin assembly 25 described above is for a three-phase reactor, FIGS. 9 and 10 illustrate a bobbin assembly 70 that can be used for a single-phase reactor or combined in threes to form a three-phase reactor. As such it shall be understood, the reactor assembly 16 of the present invention can include either of the bobbin assemblies 25, 70 and the various features described herein can be attributed to one or both. The bobbin assemblies 25, 70 can each include winding terminals 74 for securing the wire winding for each bobbin, as well as input connectors 76 that are connected to the winding terminals 74 and are configured to receive and secure external wire. Screws 78 can be included as part of the input connectors 76. More specifically, FIG. 12 shows a cross-sectional view of a reactor 116 constructed according to an alternative embodiment of the invention, using the bobbin assembly 70 shown in FIGS. 9 and 10. In this embodiment, complementary to the I-core 112, there is provided a U-core 110, with two legs 142, 143 extending downwardly from a top support 144. I-core 112 and U-core 110 are formed of laminations, welded together. In this embodiment, the bobbin assembly 70 includes two bobbins 138 and 140 wound with wire. Each of the bobbins 138, 140 has a length that is greater than the length of the legs 142, 143 so that, when the bobbin assembly 116 is assembled by sliding the bobbins onto the legs, the result is a gap 164 between the ends of the legs and the I-core 112. Structural adhesive is applied to the ends of the legs 142, 143 so as to fill the gap 164 upon assembly. A reactor mounting foot 120 can be welded to the bottom surface 122 of the I-core 112. The mounting foot 120 includes latching tabs 162 protruding outwardly therefrom. A spring clip 124, having a pair of clip arms 150, is placed over the U-core 110 such that arm inside surfaces 152 of the clip arms 150 extend through inner cavities 141 of the first bobbin 138 and the second bobbin 140. In this manner, the arm inside surfaces 152 are parallel and in abutment with the first outer wall 146 and second outer wall 148 of the U-core 110. Tab apertures 160 are situated on the ends of the clip arms 150 so that, as the clip 124 is placed over latching tabs 162 extending from the mounting foot 120, the tabs 162 snap into the apertures 160 to secure the spring clip 124 to the mounting foot 120.

Various aspects of the reactor assembly 16 can be modified and such modifications may be made by one of skill in the art of the invention without departing from the spirit or intent of the invention and therefore, the invention is to be taken as including all reasonable equivalents to the subject matter. In addition to the disclosed shapes and sizes, all the aforementioned components, can vary to include numerous adaptations. Further, in at least some embodiment, the material composition of all components can also include numerous elements, such as steel, aluminum, alloys, plastics, etc. The use of the term "plurality" in the description or claims shall be understood to include "one or more."

What is claimed is:

1. A reactor assembly comprising:

a first core comprising a plurality of stacked E-shaped planar metal laminates welded together to form a singular unit, wherein the first core further includes a plurality of legs having bottom surfaces and the plurality of legs extend perpendicularly from a top support portion, and wherein the plurality of legs includes a first outer leg, a second outer leg, and a center leg;

a bobbin assembly comprising a plurality of bobbins each having wire windings thereon and a hollow inner cavity, the plurality of bobbins including a first outer bobbin, a second outer bobbin, and a center bobbin, wherein each of the plurality of bobbins receives therein one of the plurality of legs; and wherein a terminal block is provided atop the plurality of bobbins and interconnected with the wire windings;

a second core comprising a plurality of stacked I-shaped planar metal laminates welded together to form a singular unit, the second core including a top surface and a bottom surface, wherein the top surface receives thereon the plurality of bobbins;

a mounting foot secured to the bottom surface of the second core, wherein the mounting foot includes a plurality of latching tabs; and a U-shaped spring clip that includes a pair of clip arms that each have an inside surface and a tab aperture, wherein the spring clip extends over an upper surface of the top support portion of the first core, and a first of the pair of clip arms extends downward through the inner cavity of the first outer bobbin and a second of the pair of clip arms extends downward through the inner cavity of the second outer bobbin, and wherein the tab apertures are engaged with the latching tabs to secure the spring clip to the mounting foot.

2. The reactor assembly of claim 1, wherein the first of the pair of clip arms that extends downward through the inner cavity of the first outer bobbin is parallel with and in abutment with a first outer wall that extends along the first outer leg, and the second of the pair of clip arms that extends downward through the inner cavity of the second outer bobbin is parallel with and in abutment with a second outer wall that extends along the second outer leg.

3. The reactor assembly of claim 2, wherein the plurality of legs each include a leg length, and the plurality of bobbins each include a bobbin length that exceeds the leg length.

4. The reactor assembly of claim 3, wherein a structural adhesive is applied to least part of the reactor gap that extends between the first core and the second core.

5. The reactor assembly of claim 4, wherein a structural adhesive is a single part heat cure epoxy.

6. The reactor assembly of claim 5, further including a terminal block cover secured to the terminal block.

7. The reactor assembly of claim 6, wherein the terminal block cover includes a plurality of outwardly extending phase-to-phase electrical barriers.

8. The reactor assembly of claim 1 where a separate terminal block is provided for each bobbin, and wherein the terminal blocks are separated by a distance sufficient to provide phase-to-phase voltage clearance.

9. A reactor assembly comprising:

an E-core formed of a plurality of stacked E-shaped planar metal laminates welded together to form a unit, the E-core having a plurality of legs with bottom surfaces, the plurality of legs extending perpendicularly from a top support portion, wherein the plurality of legs includes a first outer leg, a second outer leg, and a center leg;

a plurality of bobbins each having wire windings thereon and a hollow internal bobbin cavity, the plurality of bobbins including a first outer bobbin, a second outer bobbin, and a center bobbin, each of the bobbin cavities receives therein a respective one of the plurality of legs;

a terminal block positioned atop the plurality of bobbins and connected to the wire windings;

an I-core formed of a plurality of stacked I-shaped planar metal laminates welded together to form a unit, the I-core including a top surface and a bottom surface, the top surface receives thereon the plurality of bobbins;

a mounting foot secured to the bottom surface of the I-core;

a plurality of latching tabs formed on the mounting foot; and a U-shaped spring clip having a pair of clip arms spaced apart from each other, each clip arm having an inside surface and a tab aperture, the spring clip extends over an upper surface of the top support portion of the E-core, a first of the pair of clip arms extending downward through the inner cavity of the first outer bobbin and a second of the pair of clip arms extending downward through the inner cavity of the second outer bobbin, and the tab apertures to engage with the latching tabs to secure the spring clip to the mounting foot;

wherein the first of the pair of clip arms that extends downward through the inner cavity of the first outer bobbin is parallel with and in abutment with a first outer wall that extends along the first outer leg, and the second of the pair of clip arms that extends downward through the inner cavity of the second outer bobbin is parallel with and in abutment with a second outer wall that extends along the second outer leg.

10. The reactor assembly of claim 9, wherein the plurality of legs have a uniform leg length, and the plurality of bobbins have a uniform bobbin length, and wherein the bobbin length exceeds the leg length, whereby a reactor gap is formed in the reactor assembly between the E-core and the I-core.

11. The reactor assembly of claim 10, wherein a structural adhesive is applied to at least part of the reactor gap.

12. The reactor assembly of claim 11, wherein the structural adhesive is a single-part heat cure epoxy.

13. The reactor assembly of claim 12, further comprising a terminal block cover secured to the terminal block.

14. The reactor assembly of claim 13, wherein the terminal block cover includes a plurality of outwardly extending phase-to-phase electrical barriers.

* * * * *